United States Patent [19]

Marangoni et al.

[11] 4,215,764

[45] Aug. 5, 1980

[54] ACOUSTIC FILTER

[75] Inventors: Roy D. Marangoni, Pittsburgh, Pa.; Horst Gigerenzer, Hollis Center; Roger T. Pepper, Cape Elizabeth, both of Me.

[73] Assignee: Fiber Materials, Inc., Biddeford, Me.

[21] Appl. No.: 701,562

[22] Filed: Jul. 1, 1976

[51] Int. Cl.[3] ..... E04B 1/62

[52] U.S. Cl. ..... 181/286; 181/284

[58] Field of Search ..... 181/336, 284, 286

[56] References Cited

U.S. PATENT DOCUMENTS

| | | | |
|---|---|---|---|
| 3,087,569 | 4/1963 | Kurtze | 181/33 G |
| 3,239,973 | 3/1966 | Hannes et al. | 181/33 G |
| 3,738,447 | 6/1973 | Rose | 181/33 G |
| 3,860,443 | 1/1975 | Lachman et al. | 427/113 |
| 3,894,863 | 7/1975 | Lachman et al. | 75/0.5 R |
| 3,918,141 | 11/1975 | Pepper et al. | 29/419 R |

OTHER PUBLICATIONS

Richardson, Technical Aspects of Sound 1953 pp. 80–84.

*Primary Examiner*—Brooks H. Hunt

*Attorney, Agent, or Firm*—Schiller and Pandiscio

[57] ABSTRACT

An acoustical insulating material comprises a fiber reinforced lead composite sheet or panel. In a preferred embodiment of the invention the fibers are substantially axially parallel aligned with one another. The frequency absorption and transmission characteristics of the material may be varied by mechanically stressing the material, e.g. as by placing the material under tension in the direction of fiber orientation.

12 Claims, 3 Drawing Figures

ACOUSTIC FILTER

Figure 1:
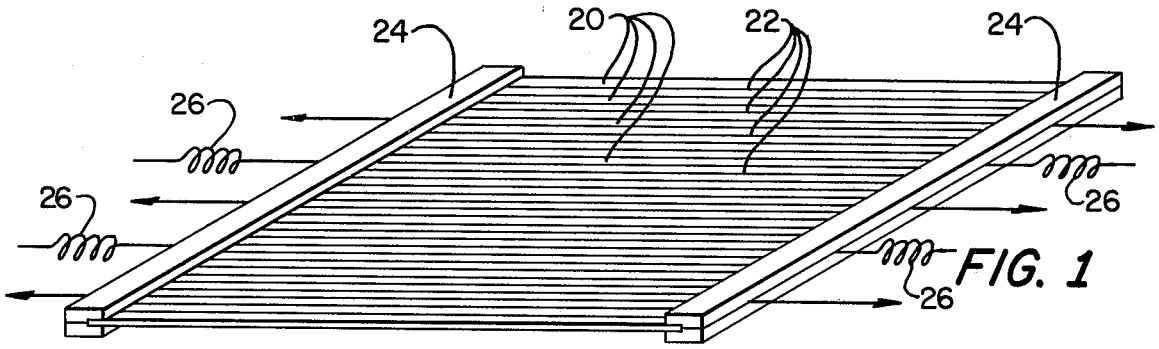

This invention relates to acoustical systems and more particularly to a novel material and method for insulating and filtering sound.

The manner in which a material absorbs sound is basically due to its ability to dissipate incident sound energy as heat losses. Three common types of absorption materials are porous structures, cavity resonators, and panels.

Porous structures are generally considered best suited for absorbing relatively high frequency sound. Such structures absorb sound by conduction between the air in the porosities and the solid parts of the body or materials. Similarly, solid friction also may occur between the solid parts of the body which are thus set in relative motion by the sound.

Cavity structures are generally considered better suited for absorbing relatively low frequency sound, (e.g. below 500 cps). Cavity structures (also called "Helmholtz Resonators") usually each consist essentially of a narrow neck in a rigid wall communicating with an enclosed volume of air. The air in the neck acts as a mass, and in response to the sound waves incident thereon, compliance is provided by the enclosed volume of air inside the wall. Some sound energy is also dissipated in scattering.

Thin panel absorbers such as walls, etc. absorb sound energy by dissipating the energy by molecular absorption with the wall. Thin panels also rely to a lesser extent on reflecting the sound wave back towards the source. Thus, the most effective thin panel sound absorbers or insulators are usually heavy and solid.

It is generally considered that lead is a good acoustic absorption material due to its relatively high density. Thus lead sound absorbers are able to dissipate internally large amounts of sound energy incident on the structure without transmitting or reflecting the sound. On the other hand, due to its relatively low tensile and compressive strength, relatively poor load carrying ability, and relatively little flexual strength, lead has not achieved substantial commercial usage as an architectural building material. As a result use of lead as an acoustic absorption material is largely restricted to where it is used as an acoustical lining.

Furthermore, in the case of most known sound insulating material, the frequency absorption and transmission characteristics of the material is usually a fixed function of the material per se and/or physical dimensions of the insulating member.

It is thus a primary object of the present invention to provide a novel and efficient sound insulating system. Another object of the present invention is to provide a sound insulating material which material can also be employed as an architectural structural building material. Still another object is to provide an acoustical material in which the frequency absorption and transmission characteristics may be adjusted, i.e. tuned. Yet other objects of the present invention will in part appear obvious and will in part appear hereinafter.

The invention accordingly comprises the process and the several steps and the relation of one or more of such steps with respect to each of the others, and the products possessing the features, properties and relation of elements which are exemplified in the following detailed disclosure and the scope of the invention all of which will be indicated in the claims.

Generally to effect the foregoing and other objects the present invention involves a fiber reinforced lead structure or composite body. The frequency absorption and transmission characteristics of the composite body may be varied by mechanically stressing the body, e.g. as by placing the body under tension.

Figure 2:
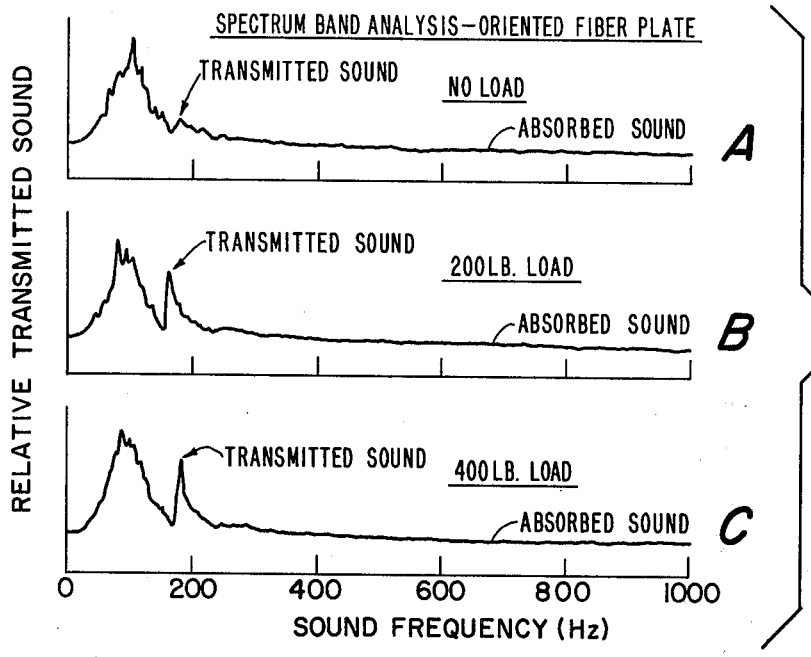
Figure 3:
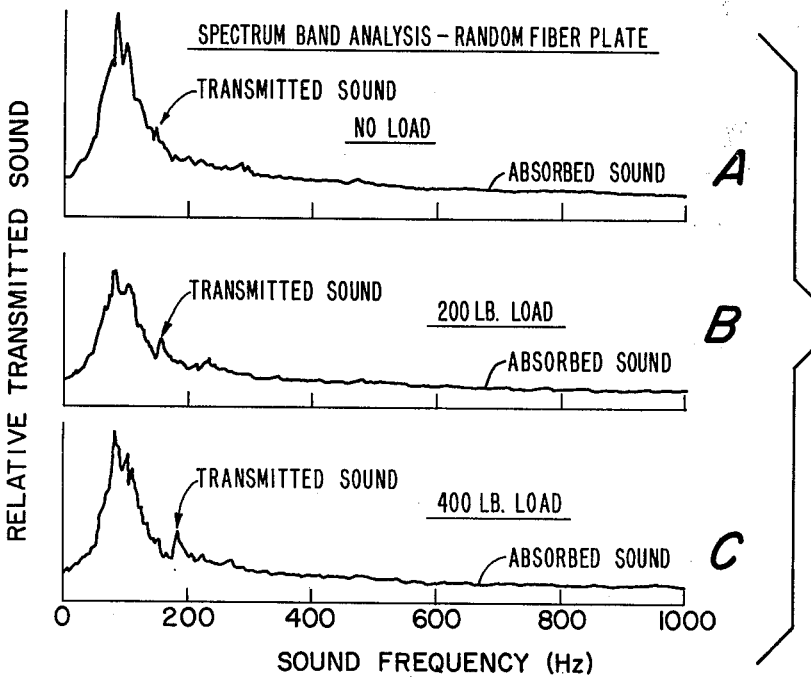

For a fuller understanding of the nature and objects of the present invention, reference should be had to the following detailed description taken in connection with the accompanying drawings wherein:

FIG. 1 is a block and schematic view of an acoustic filtering panel in accordance with the present invention;

FIG. 2 is a plot of frequency against transmissivity showing the comparison of frequency of sound energy transmitted through a unidirectional oriented fiber reinforced lead acoustic panel in accordance with the teachings of the present invention, under various amounts of tension; and FIG. 3 is a plot of frequency of sound energy transmitted through a random fiber reinforced lead acoustic panel in accordance with the teachings of the present invention, under various amounts of tension.

Carbon based fibers are generally preferred in the practice of the present invention as being stronger and stiffer than glass or metal fibers and more readily available commercially. However, it is intended that the term "fiber" should include both graphite and non-graphite carbon fibers as well as non-carbon based fibers such as glass fibers or metal fibers or wires such as copper or steel. The fibers which may be either substantially aligned axially parallel to one another or randomly oriented, may be incorporated into the lead using a variety of methods known in the art for producing fiber/metal composites such as liquid infiltration, powder metallurgy or by soldering.

In preferred form, the fibers are aligned graphite fibers derived from rayon precursor yarn of approximate average diameter in the range of about 6–7 microns and average length of from $\infty$ to 0.1 inches. Graphite fibers of this type are well known and are available commercially.

The lead preferably comprises substantially pure lead, although alloys with various amounts of other metals such as antimony and tin may be employed. For example, a lead-tin solder alloy comprising 80 wt. % of lead, the balance tin, or a leadbase Babbit's metal comprising 80 wt. % of lead, 15 wt. % of antimony, the balance tin, may be employed for forming the tunable sound insulating panel in accordance with the instant invention. Preferably however, the alloy should comprise a minimum of about 50 wt. % of lead to achieve the advantages of the invention.

A preferred embodiment of acoustic filtering panel is shown in FIG. 1 of the drawings. Referring to FIG. 1, a substantially flat sheet of lead generally at 20 is provided with a plurality of substantially axially parallel aligned elongate reinforcing fibers 22. However, it will be understood that the reinforcing fibers may be randomly oriented. The fibers are incorporated into the lead sheet so as to form a fiber/lead composite material.

The lead/fiber composite materials employed in the instant invention are known per se in the art, and various methods for forming the composite materials are also known. Thus, for example, in the case of graphite fibers, the fibers may be coated with a wetting agent comprising titanium boride, titanium carbide or a mixture of both. The coated fibers are then impregnated with lead by outgassing the fibers by pumping them down to a very low pressure, and submerging the outgassed fibers into a pressurized molten lead bath to fill the interstices of the fibers as taught in U.S. Pat. Nos. 3,860,443 and 3,894,863 to Walter L. Lachman et al. If desired, the composite may be formed initially using a random mat and the fibers may then be substantially axially parallel aligned by hot working the fiber/lead composite material acording to the method as taught in U.S. Pat. Nos. 3,918,141 to Roger T. Pepper and Frank Bucherati.

Composites of lead with other fiber materials may also be formed. For example, Schwope et al U.S. Pat. No. 3,510,275 report that metallic fibers such as steel may be dispersed in a powder matrix of lead, and the fiber may be oriented by working methods such as forging, swaging, rolling, extrusion and the like such that the powder metal is hot worked while the fiber material is cold worked. Alternatively, metallic wires such as steel may be incorporated into the lead by soldering.

And, Parrott U.S. Pat. No. 3,442,992 teaches producing fiber reinforced composite materials by dispersing fibers such as glass in a viscous liquid medium, extruding the mixture through an orifice and treating the extruded mixture to change the liquid to a solid. The carrier may then be removed by burning, and the glass fibers may then be infiltrated by molten metal using conventional outgassing, etc. techniques as above described.

The fiber reinforced lead composite sheet is then machined to a desired size and the sheet is then supported in a frame 24 to form a fiber reinforced lead panel. The panel can then be tuned over a limited range, i.e. frequency absorption and transmission characteristics of the panel may be varied, by applying a tensile stress along the fiber reinforced lead panel. For example, the frame may be supported between springs 26, and a load placed on the springs. The amount of stress applied to the material under tension may vary over a wide range, e.g. up to about 95% of the tensile yield strength of the fiber. In a preferred embodiment of the invention the fibers are substantially axially parallel aligned, and the mechanical stress is applied to the composite material by placing the material under tension (in the direction of fiber orientation) at about 1 to 80% of the tensile yield strength of the fiber.

Other means by which a tensile stress may be applied to a body are known in the art and may be employed for applying the required tensile stress to the reinforced sheet in accordance with the present invention.

The following examples illustrate more clearly the manner in which acoustical insulating materials may be provided and used according to the invention. The invention however, should not be construed as limited to the particular embodiments set forth in the examples which are given as merely exemplary.

EXAMPLE I

Graphite yarn of approximately 0.06 inches diameter and 300,000 psi tensile strength, containing approximately 11,000 individual fibers of $50\times10^6$ modulus rayon precursor yarn was exposed to a vapor reaction mixture formed of 0.38% $TiCl_4$, 0.21% $BCl_3$, and 0.80% Zn, the balance being argon (all percentages being by weight). The gas mixture was maintained at a temperature of 650° C. for 30 minutes to provide a coating of about 200 Å, believed to be substantially $TiB_2$ on the yarn fibers. The coated fibers were transferred under argon to a molten bath containing 99.5 wt. % lead and 0.5 wt. % tin and kept immersed in the bath at 650° C. for 2 minutes. The resulting metal-fiber composite was removed from the bath and then allowed to cool below the solidus temperature of the alloy to form graphite/-lead composite wires.

The resulting graphite/lead composite wires were cut to 6 inch length and were then assembled, substantially unidirectionally aligned, in a steel die between two 0.06 inch thick pure lead sheets. The assembly was then pressed under argon at 260° C. under 1000 psi pressure for 30 minutes, to form a 6×6 inch fiber reinforced lead panel.

The resulting panel was fitted (top and bottom) into a frame 24 (FIG. 1) and the frequency absorption and transmission characteristics of the framed panels were tested in an anechoic channel as follows:

The panel was placed under various tensile loads (in the direction of fiber orientation) and examined to determine the frequency absorption and transmission characteristics. A typical frequency response curve of the material as produced hereinabove is shown over a sound frequency range of 0–1000 Hz under no tension (FIG. 2A), 200 pound tension load (FIG. 2B) and 400 pound tension load (FIG. 2C) plotted against ordinates of relative transmitted sound. The curves in FIG. 2 show that the frequency spectrum of transmitted acoustic energy is changed by mechanically stressing the composite panel, with the effect being more pronounced as mechanical stressing is increased. (The large peak in the spectral curves at 100 Hz is attributed to the characteristics of the anechoic channel).

EXAMPLE II

The process of Example I was repeated with the following difference. The graphite fiber comprised randomly oriented graphite mat of 200,000 psi tensite strength and 30 million psi modulus. The mat was coated and infiltrated with 99.5 wt. % lead –0.5 wt. % tin alloy and formed into a 6×6 inch lead/fiber composite panel as before.

The resulting panel was placed in a frame and the frequency absorption and transmission characteristics of the framed panel was tested in an anechoic channel as in Example I. The frequency spectrum of transmitted acoustic energy of the panel under various tension loads is shown in FIG. 3A, B and C. It was noted that the effect of increasing mechanical stress on frequency spectrum of transmitted acoustic energy was much less pronounced in the case of composites in which the fibers were randomly oriented than when axially of parallel aligned.

EXAMPLE III

A lead/steel fiber composite panel is formed as follows: The steel wire comprises 0.007 inch diameter tin coated steel piano wire of 440,000 psi tensile strength and 30 million psi modulus. Three hundred pieces of steel wire as above described, each 6 inches long, were placed, substantially uniformly spaced apart and aligned parallel with one another in a 6×6 inch steel die between two pure lead sheets of 0.06 inch thickness. Prior to assembly, the innerfaces of the lead sheets were coated with a commercial solder flux paste containing 5 wt. % zinc chloride, 45 wt. % lead and 45 wt. % tin. The wire-lead sheet assembly was bonded at 230° C. and 280 psi pressure in air for five minutes to form a 6×6 inch lead/steel composite panel.

The resulting panel was placed in a frame and the frequency transmission characteristics of the framed panel were tested in an anechoic channel as in Example I.

Acoustic testing at 0, 200 and 400 pound tension load (in the direction of fiber orientation) showed that the frequency spectrum of transmitted acoustic energy was changed by varying the mechanical stress on the panel as in Example I.

One skilled in the art will appreciate a principal advantage of the present invention resides in the fact that the mechanical strength of acoustic lead panels may be enhanced, i.e. so that the panels may be employed both as sound insulators and as structural building materials. Another principal advantage resides in the ability to modify the frequency absorption and transmission characteristics of acoustic lead panels.

Certain changes may be made in the above method and product without departing from the scope of the invention herein involved. For example, one skilled in the art will recognize that the mechanical strength of the composite may be modified by varying the filter volume-to-matrix volume on the type of fiber materials used, and that the frequency absorption and transmission characteristics of the resulting composite will also be modified by such variations. It is therefore intended that all matter contained in the above description or shown in the accompanying drawing shall be interpreted in an illustrative and not in a limiting sense.

What is claimed is:

1. A tunable sound insulating panel assembly comprising in combination:

a fiber reinforced lead composite sheet having acoustical frequency transmission and absorption characteristics and means for applying a predetermined tensile stress along said sheet so as to modify said acoustical frequency absorption and transmission characteristics of said sheet.

2. A sound insulating panel as defined in claim 1 wherein said means for applying said predetermined tensile stress comprises a substantially rigid frame for holding said sheet in tension.

3. A sound insulating panel as defined in claim 2 wherein said sheet comprises fibers substantially axially parallel aligned with one another, and said rigid frame is for holding said sheet under tension in the direction of fiber orientation.

4. A sound insulating panel as defined in claim 3 wherein said fibers are selected from the group consisting of carbon, graphite, glass, copper and steel.

5. A sound insulating panel as defined in claim 3 wherein said fibers comprise carbon fibers.

6. A sound insulating panel as defined in claim 3 wherein said fibers comprise glass fibers.

7. A sound insulating panel as defined by claim 3 wherein said fibers comprise steel fibers.

8. A sound insulating panel as defined by claim 5, wherein said carbon fibers have a coating selected from the group consisting of titanium boride, titanium carbide and mixtures of titanium boride and titanium carbide.

9. A method of forming a tunable sound insulating panel, comprising the steps of: forming a fiber reinforced lead composite sheet, and applying a tensile stress along said sheet so as to adjust the acoustical absorption and transmission characteristics of said sheet.

10. A method as defined in claim 9 including the step of substantially axially parallel aligning said fibers in said sheet, and applying said stress in the direction of fiber orientation.

11. A method of enhancing the mechanical strength of lead and also forming a sound insulating panel comprising the said lead, said method comprising the steps in sequence of:

(1) forming a fiber reinforced composite sheet with the said lead, and

(2) applying a tensile stress along said sheet so as to adjust the acoustical absorpotion and transmission characteristics of said sheet.

12. A method as defined in claim 11 including the step of substantially axially parallel aligning said fibers in said composite, and applying said stress in the direction of fiber orientation.

* * * * *